US011428114B1

(12) United States Patent
Kanoffsky et al.

(10) Patent No.: US 11,428,114 B1
(45) Date of Patent: Aug. 30, 2022

(54) ACTUATION LEVER FOR TURBINE VTG

(71) Applicant: BorgWarner Inc., Auburn Hills, MI (US)

(72) Inventors: Nico Kanoffsky, Bolanden (DE); Thomas Ramb, Worms (DE)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 17/542,764

(22) Filed: Dec. 6, 2021

(30) Foreign Application Priority Data

Oct. 22, 2021 (DE) ..... 20 2021 105 795.5

(51) Int. Cl.
*F02B 37/24* (2006.01)
*F01D 17/16* (2006.01)
*F02B 37/18* (2006.01)

(52) U.S. Cl.
CPC ..... *F01D 17/165* (2013.01); *F02B 37/186* (2013.01); *F02B 37/24* (2013.01); *F05D 2220/40* (2013.01); *F05D 2230/22* (2013.01); *F05D 2230/237* (2013.01); *F05D 2260/31* (2013.01); *F05D 2300/171* (2013.01); *F05D 2300/506* (2013.01); *F05D 2300/516* (2013.01)

(58) Field of Classification Search
CPC ..... F01D 17/165; F02B 37/186; F02B 37/24; F05D 2220/40; F05D 2230/22; F05D 2230/237; F05D 2260/31; F05D 2300/171; F05D 2300/506; F05D 2300/516
See application file for complete search history.

(56) References Cited

U.S. PATENT DOCUMENTS

2010/0028142 A1* 2/2010 Hashimoto ..... F02C 6/12 415/200
2015/0086340 A1* 3/2015 Ramb ..... F02C 6/12 415/148

* cited by examiner

*Primary Examiner* — Audrey B. Walter
*Assistant Examiner* — Edward Bushard
(74) *Attorney, Agent, or Firm* — Eric L. Doyle; Stephan A. Pendorf; Patent Central LLC

(57) ABSTRACT

A lever for a VTG guide vane arrangement of a radial turbine with a main body with a fork-shaped coupling section with two limbs. A wear-resistant contact block is arranged on an inner side of at least one of the limbs. The wear-resistant contact block is designed for operative engagement with an adjusting ring of the VTG guide van arrangement, giving rise to the effect of increased wear resistance at least in the region of the engagement with the VTG guide vane arrangement. Furthermore, a VTG guide vane arrangement having such a lever, a radial turbine having such a VTG guide vane arrangement, and a supercharging device having such a radial turbine.

16 Claims, 4 Drawing Sheets

ACTUATION LEVER FOR TURBINE VTG

TECHNICAL FIELD

The present invention relates to a lever for a VTG guide vane arrangement of a radial turbine. The invention furthermore relates to a VTG guide vane arrangement having such a lever, and to a radial turbine having such a VTG guide vane arrangement and to a supercharging device having such a radial turbine.

BACKGROUND

Ever-increasing numbers of vehicles of the newer generation are being equipped with supercharging devices in order to achieve the required aims and satisfy legal regulations. In the development of supercharging devices, it is the aim to optimize the individual components and the system as a whole with regard to their reliability and efficiency.

Known supercharging devices normally have at least one compressor with a compressor wheel which is connected to a drive unit via a common shaft. The compressor compresses the fresh air that is drawn in for the internal combustion engine or for the fuel cell. In this way, the air or oxygen quantity that is available to the engine for combustion or to the fuel cell for reaction, respectively, is increased. This in turn leads to an increase in performance of the internal combustion engine or of the fuel cell respectively. Supercharging devices may be equipped with different drive units. In particular, electric superchargers, in the case of which the compressor is driven by means of an electric motor, and turbochargers, in the case of which the compressor is driven by means of a turbine, in particular a radial turbine, are known in the prior art. By contrast to an axial turbine, as are used for example in aircraft engines, in which there is a substantially exclusively axial incident flow, it is the case in a radial turbine that the exhaust-gas flow is conducted substantially radially, and in the case of a mixed-flow radial turbine semi-radially, that is to say with at least a small axial component, from a spiral-shaped turbine inlet onto the turbine wheel. Aside from electric superchargers and turbochargers, combinations of both systems are described in the prior art, these also being referred to as E-turbos.

In order to increase the efficiency of turbines and adapt it to different operating points, variable guide vanes are commonly used in turbines, which variable guide vanes can be adjusted such that an incident-flow angle and a flow cross section of the flow that is conducted onto the turbine wheel can be variably set. Such systems are also known as variable turbine geometry, VTG or guide vane arrangement.

Known guide vane arrangements commonly have a vane bearing ring with a multiplicity of guide vanes mounted in a circle on said vane bearing ring, which guide vanes are each adjustable from a substantially tangential position with respect to the circle into an approximately radial position. An operating device is provided for generating control movements, which are to be transmitted to the guide vane arrangement with variable turbine geometry, by means of an adjusting ring which is arranged coaxially with the vane bearing ring and to which the guide vanes are movably connected. The operating device commonly has an actuator that is coupled via an adjusting shaft and an inner lever to the adjusting ring. For the mechanical coupling of the operating device to the adjusting ring, an engagement of the inner lever with an actuation pin of the adjusting ring is commonly provided. The large number of movable individual parts of the VTG guide vane arrangement commonly requires a complex and expensive assembly process and can lead to wear problems during operation.

It is an object of the present invention to provide an improved VTG guide vane arrangement with adjustable guide vanes.

SUMMARY OF THE INVENTION

The present invention relates to a lever for a VTG guide vane arrangement of a radial turbine, according to claim 1.

The lever according to the invention comprises a main body with a fork-shaped coupling section. The fork-shaped coupling section comprises, in turn, two limbs. A wear-resistant contact block is arranged on an inner side of at least one of the limbs. The wear-resistant contact block is designed for operative engagement with an adjusting ring of the VTG guide vane arrangement. This gives rise to the effect of increased wear resistance at least in the region of the engagement with the VTG guide vane arrangement. In this way, it is firstly possible for the durability of the lever and thus of the VTG guide vane arrangement to be increased. Secondly, other material regions of the lever and of the VTG guide vane arrangement that are not subjected to mechanical load, or are subjected at least to lower mechanical load, can be produced from materials that are optimized for other characteristics. To name just a few examples, it is for example possible for materials which are cheaper, weight-optimized, strength-optimized and/or optimized with regard to weldability to be used for the other material regions. This can yield a corresponding variety of advantages, such as assembly advantages, economical advantages, ecological advantages and/or performance-related advantages.

In embodiments of the lever, in each case one wear-resistant contact block may be arranged on the inner side of both limbs and be designed for operative engagement with the adjusting ring of the VTG guide vane arrangement. This yields further increased wear resistance, because that side of the fork-shaped section which is in opposition to the natural restoring force of the guide vanes is also of wear-resistant form for potential contact with the VTG guide vane arrangement. The natural restoring force arises from the flow which is incident on the guide vanes and which generates a torque from a more tangential orientation of the guide vanes to a more radial orientation of the guide vanes. The adjusting ring or the actuation pin thus tends to lie against the fork-shaped section in the direction of rotation that corresponds to a movement in the direction of a more radial orientation of the guide vanes. In other words, the actuation pin tends to lie against the inner side of that limb in the direction of which the guide vanes orient themselves owing to a more radial orientation.

In embodiments of the lever that are combinable with the embodiment above, the wear-resistant contact block may form a coupling surface. The coupling surface may be capable of being placed in operative engagement with an actuation pin of the adjusting ring for the purposes of adjusting the VTG guide vane arrangement. The wear-resistant contact block may be subjected to mechanical postprocessing in order to form the coupling surface. In particular, the wear-resistant contact block may be subjected to cutting postprocessing in order to form the coupling surface. For example, the wear-resistant contact block may be ground in order to form the coupling surface. This gives rise to the effect of a very smooth surface, which in turn leads to reduced friction and/or increased wear resistance.

In embodiments that are combinable with any one of the preceding embodiments, the wear-resistant contact block may be subjected to postprocessing such that the coupling surface has an average roughness depth of Rz≤5 μm. The coupling surface may particularly preferably have an average roughness depth of Rz≤4 μm. At the least, the average roughness depth of the coupling surface may have a value of Rz≤20 μm, in particular of Rz<10 μm. An average roughness depth of 10 μm or less has proven to be more wear-resistant than greater roughness depths. In particular, average roughness depths of approximately 3 μm to 5 μm constitute a good compromise between increased wear resistance and good manufacturability.

In embodiments with two wear-resistant contact blocks, which are combinable with any one of the preceding embodiments, the wear-resistant contact blocks may be arranged spaced apart from one another such that a coupling cutout is formed between the wear-resistant contact blocks. The coupling cutout may be configured for operative engagement with the actuation pin of the adjusting ring. Thus, during operation when installed in a VTG guide vane arrangement, the wear-resistant contact blocks can come into low-wear contact with the actuation pin by way of the coupling cutout.

In embodiments that are combinable with any one of the preceding embodiments, the wear-resistant contact block may have a thickness of at least 0.1 mm between the inner side of the limb and the coupling surface formed by the wear-resistant contact block. For example, the thickness of the wear-resistant contact block may be 0.1 mm to 3.0 mm, in particular at least 0.5 mm, and preferably 0.6 mm to 1.0 mm. In some particularly preferred embodiments, the thickness of the wear-resistant contact block may be 0.8 mm+/−0.1 mm, which thicknesses lead to particularly good wear resistance and material efficiency. In some embodiments, the wear-resistant contact block may have a variable thickness, which is at least 0.5 mm at at least one location and is approximately 0.1 mm or less at at least one other location. By means of such embodiments, particularly material-efficient and positionally accurate or requirement-based wear resistance can be provided.

In embodiments that are combinable with any one of the preceding embodiments, the wear-resistant contact block may be fastened to the limb.

In embodiments that are combinable with the preceding embodiment, the wear-resistant contact block may be fastened in non-positively locking and/or positively locking fashion to the limb. For example, the wear-resistant contact block may be fastened to the limb by means of a screw connection. This allows easy assembly and easy maintenance.

As an alternative to the non-positively locking and/or positively locking fastening, the wear-resistant contact block may be fastened cohesively to the limb. For example, the wear-resistant contact block may be fastened to the limb by means of a welded connection and/or by means of a brazed connection. In some embodiments, the wear-resistant contact block may be fastened to the limb by powder-metallurgical methods.

In embodiments that are combinable with any one of the preceding embodiments, the main body may be produced at least partially from a first material. In embodiments, the main body may be produced at least partially from the first material by powder-metallurgical methods. In embodiments, the first material may be a metallic material. In embodiments, the first material may be a steel alloy with good welding characteristics. For example, the first material may comprise or be composed of Fe17Cr13Ni, X30CrNiNbSi25-20, X6CrNiMoTi17-12-2 and/or X2CrNiMo17-12-2.

In embodiments that are combinable with any one of the preceding embodiments, the wear-resistant contact block may be produced from a second material. The second material may differ from the first material. In particular, the second material may have greater wear resistance than the first material. In embodiments, the wear-resistant contact block may be produced from the second material by powder-metallurgical methods. In embodiments, one or both limbs may be produced from the second material, in particular by powder-metallurgical methods. In some embodiments, the fork-shaped coupling section may be produced from the second material. In embodiments, the second material may be a metallic material. In particular, the second material may be a steel alloy with a cobalt content of at least 20%. For example, the second material may comprise or be composed of Co30Cr8W or Co30Mo9Cr.

In embodiments that are combinable with any one of the preceding embodiments, the lever may be produced by metal injection molding or composite casting.

In embodiments that are combinable with any one of the preceding embodiments, the main body may furthermore comprise a shaft section for coupling to an adjusting shaft. The shaft section may be arranged opposite the fork-shaped coupling section. In embodiments, the lever may have an at least partially arcuate profile from the shaft section to the fork-shaped coupling section. In the installed state, the arcuate profile gives rise to an arrangement of the fork-shaped coupling section axially closer to the adjusting ring, which can result in an improvement in the kinematics and a reduced risk of tilting. Alternatively or in addition to the arcuate profile, the lever may have a stepped formation between the shaft section and the fork-shaped coupling section. In particular, the lever may have a stepped formation axially from the shaft section to the fork-shaped coupling section, such that the fork-shaped coupling section is arranged closer to the adjusting ring in the installed state. This, too, can give rise to an improvement in the kinematics and a reduced risk of tilting.

In embodiments that are combinable with any one of the preceding embodiments, the wear-resistant contact block may have a hardness of at least 500 HV0.1. In particular, the wear-resistant contact block may have a hardness of between 500 HV0.1 and 1000 HV0.1. Preferably, the wear-resistant contact block may have a hardness of between 650 HV0.1 and 800 HV0.1.

The invention furthermore relates to a VTG guide vane arrangement of a radial turbine for a supercharging device. The VTG guide vane arrangement comprises a vane bearing ring, a multiplicity of guide vanes and an adjusting ring. The multiplicity of guide vanes is mounted rotatably in the vane bearing ring. The adjusting ring is configured to rotate the guide vanes. The VTG guide vane arrangement furthermore comprises a lever according to any one of the preceding embodiments. The lever is in operative engagement with an actuation pin of the adjusting ring in order to rotate the adjusting ring.

In embodiments of the VTG guide vane arrangement, the guide vanes may each have a vane shaft and a vane lever. The vane levers may be operatively coupled to the adjusting ring. The guide vanes may be mounted rotatably in the vane bearing ring by means of the vane shafts in a manner distributed in the circumferential direction. In embodiments, the adjusting ring may have engagement recesses into which the vane levers engage.

In embodiments of the VTG guide vane arrangement that are combinable with any one of the preceding embodiments, the coupling surface of the wear-resistant contact block may be oriented perpendicular to an axis of the actuation pin. The wear resistance can be increased in this way.

In embodiments of the VTG guide vane arrangement that are combinable with any one of the preceding embodiments, the actuation pin may be arranged between the wear-resistant contact blocks.

The invention furthermore relates to a radial turbine for a supercharging device. The radial turbine comprises a turbine housing, a turbine wheel and a VTG guide vane arrangement according to any one of the preceding embodiments. The turbine housing defines a supply duct and an outlet duct. The turbine wheel is arranged in the turbine housing between the supply duct and the outlet duct. In embodiments, the VTG guide vane arrangement is arranged radially outside the turbine wheel.

The invention furthermore relates to a supercharging device for an internal combustion engine or a fuel cell. The supercharging device comprises a bearing housing, a shaft and a compressor with a compressor wheel. The shaft is mounted rotatably in the bearing housing. The supercharging device furthermore comprises a radial turbine according to any one of the preceding embodiments. The turbine wheel and the compressor wheel are arranged rotationally conjointly on the shaft at opposite ends.

In embodiments, the supercharging device may furthermore comprise an electric motor. In embodiments, the electric motor may be arranged in the bearing housing. The electric motor may be configured to drive the shaft in rotation.

DETAILED DESCRIPTION

Figure 1:
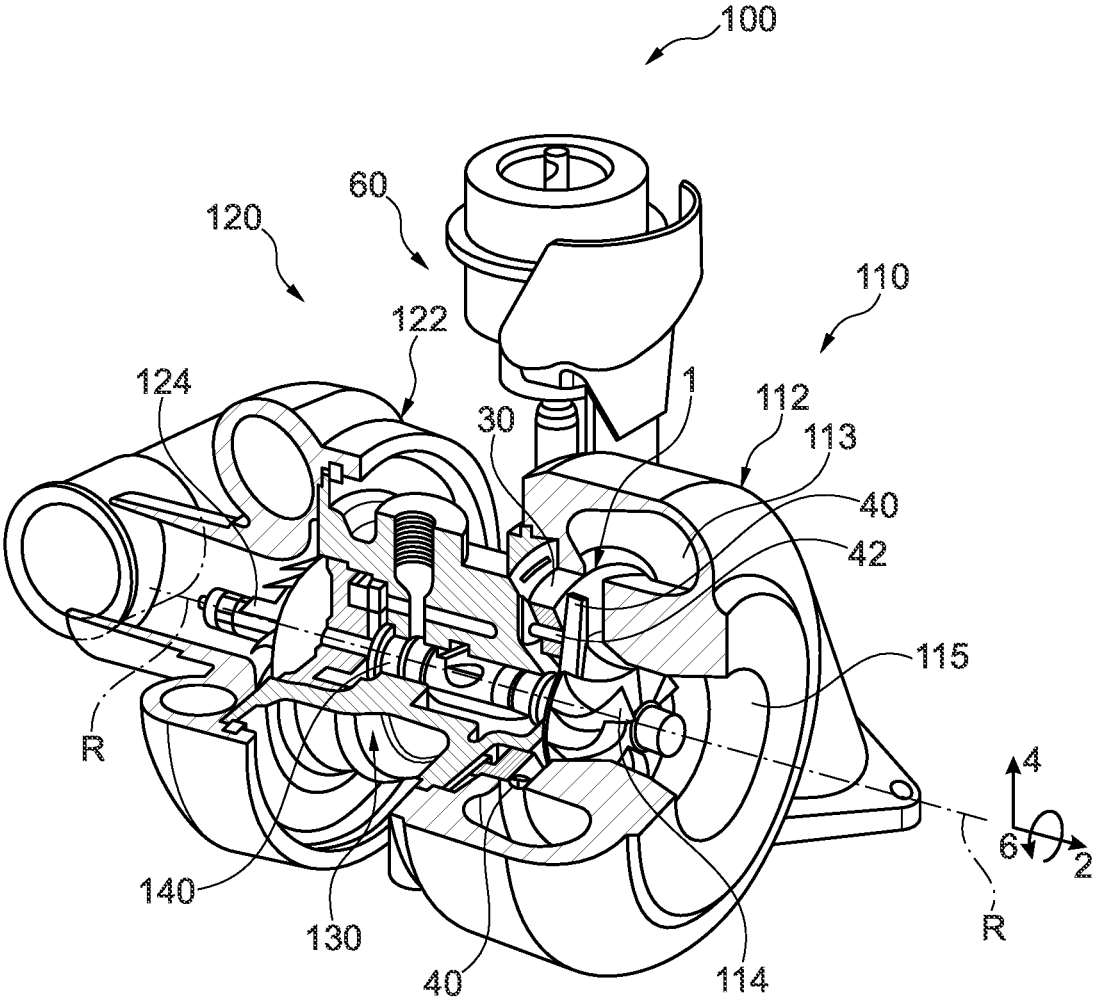
FIG. 1 is a sectional, perspective illustration of the basic construction of a supercharging device according to the invention.

In the context of this application, the expressions "axial" and "axial direction" relate to an axis of rotation of the radial turbine 110 or of the turbine wheel 114 and/or of the VTG guide vane arrangement 1 or of the adjusting ring 20. With regard to the figures (see for example FIG. 1), the axial direction of the radial turbine 110 or of the VTG guide vane arrangement 1 is illustrated by the reference designation 2. A radial direction 4 relates here to the axis/axial direction 2 of the radial turbine 110 or of the VTG guide vane arrangement 1. Likewise, a circumference or a circumferential direction 6 relates here to the axis/axial direction 2 of the radial turbine 110 or of the VTG guide vane arrangement 1.

FIG. 1 illustrates a supercharging device 100 according to the invention, which comprises a radial turbine 110, a compressor 120 and a bearing housing 130.

The radial turbine 110 comprises a turbine housing 112, a turbine wheel 114 and a VTG guide vane arrangement 1. The VTG guide vane arrangement 1 is illustrated only schematically in FIG. 1 and will be discussed in detail further below with regard to FIG. 2. The turbine housing 112 defines a supply duct 113 and an outlet duct 115. The turbine wheel 114 is arranged in the turbine housing 112 between the supply duct 113 and the outlet duct 115. The supply duct 113 can also be referred to as turbine spiral. The VTG guide vane arrangement 1 is arranged radially outside the turbine wheel 114. More specifically, the VTG guide vane arrangement 1 is arranged between the supply duct 113 and the turbine wheel 114.

The compressor 120 comprises a compressor housing 122 and a compressor wheel 124 arranged rotatably therein. The supercharging device 100 furthermore comprises a shaft 140 that is rotatably mounted in the bearing housing 130. The turbine wheel 114 and the compressor wheel 124 are arranged rotationally conjointly on the shaft 140 at opposite ends. The housings 112, 130 and 122 are arranged along an axis of rotation R of the shaft 140.

The supercharging device 100 may basically be used, and/or correspondingly configured or dimensioned, for an internal combustion engine or a fuel cell.

In the embodiment of FIG. 1, the supercharging device 100 is in the form of a turbocharger. In embodiments, the supercharging device 100 may be in the form of an E-turbo (not illustrated in FIG. 1). For example, the supercharging device 100 may furthermore comprise an electric motor. In some embodiments, the electric motor may be arranged in the bearing housing 130. The electric motor may be configured to drive the shaft 140 in rotation. In some embodiments, an electromagnetically active element may be arranged on the shaft 140. The electric motor or the stator thereof may be configured to drive the electromagnetically active element, and thus the shaft 140 itself, in rotation.

The turbine housing 112 is shown partially in section in FIG. 1 in order to illustrate the arrangement of a vane bearing ring 30 as part of the VTG guide vane arrangement 1 which has a multiplicity of guide vanes 40 which are distributed in the circumferential direction 6 and which have pivot spindles or vane shafts 42. Formed between adjacent guide vanes 40 are nozzle cross sections which, in a manner dependent on the present position of the guide vanes 40, are larger or smaller and accordingly apply a greater or lesser amount of exhaust gas of an internal combustion engine or of a fuel cell to the turbine wheel 114 mounted at the axis of rotation R in order, by way of the turbine wheel 114, to drive a compressor wheel 124 that is seated on the same shaft 140. In order to control the movement or the position of the guide vanes 40, an operating device 60 is provided, which itself may be of any desired form, for example electronic or pneumatic, to name just two examples. In the example of FIG. 1, the operating device is of pneumatic form with a control housing (for example a pressure capsule) and a plunger element that transmits the movement of the control housing via one or more intermediate elements to the VTG guide ring 1 or the guide vanes 40.

Figure 2:
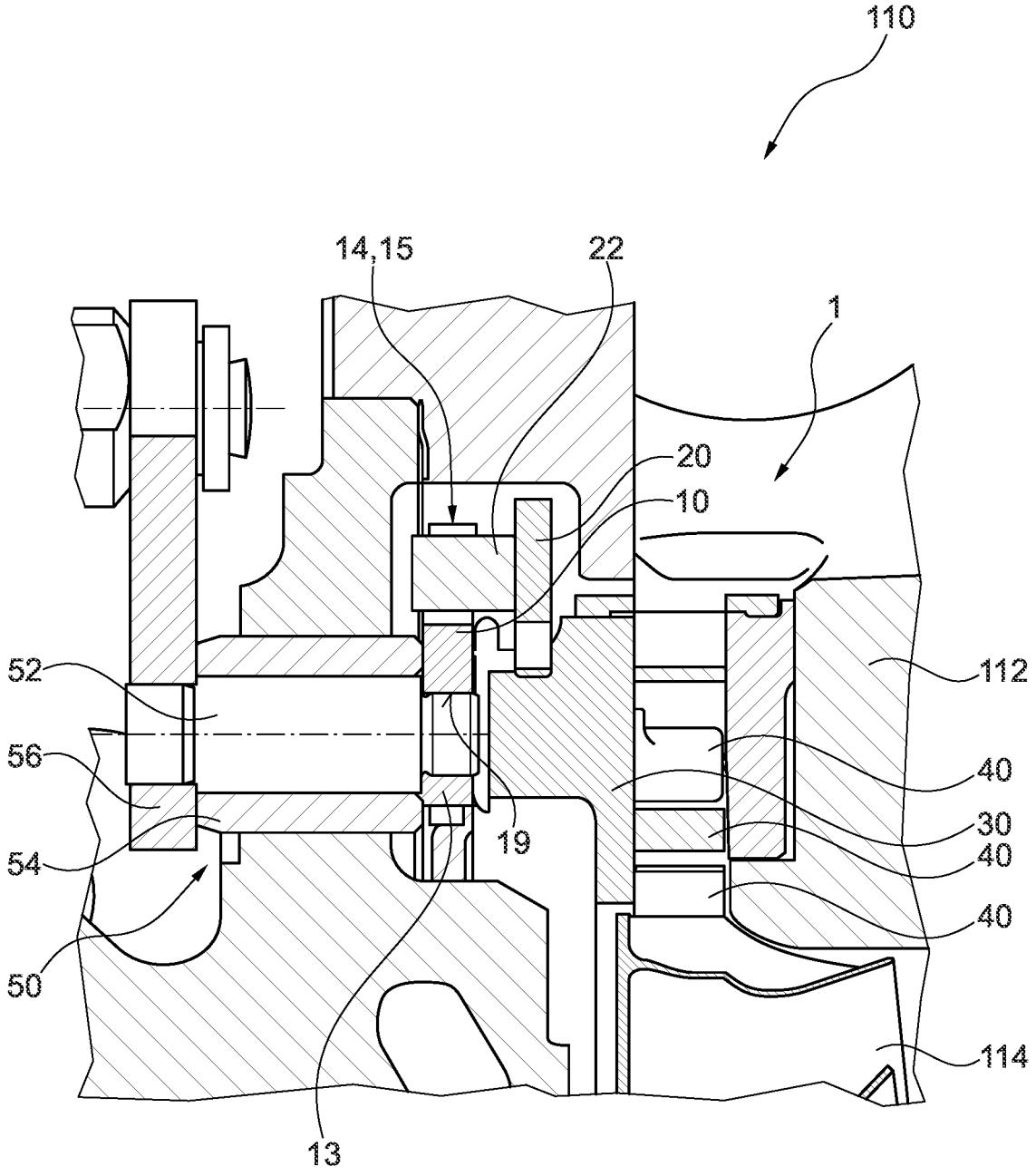
FIG. 2 is a sectional illustration of a part of the supercharging device according to the invention with the inner lever in engagement with the adjusting ring.

In this regard, FIG. 2 shows a detail of the VTG guide vane arrangement 1 installed in the radial turbine 110 in a sectional side view. Aside from the vane bearing ring 30 and the guide vanes 40, the VTG guide vane arrangement 1 comprises an adjusting ring 20, by means of which the guide vanes 40 are adjusted or rotated. The multiplicity of guide vanes 40 is mounted rotatably in the vane bearing ring 30. More specifically, the guide vanes 40 each have a vane shaft 42, by means of which they are mounted rotatably in the vane bearing ring 30. In other words, the guide vanes 40 may be mounted rotatably in the vane bearing ring 30 by means of the vane shafts 42 in a manner distributed in the circumferential direction 6. Here, the vane shafts 42 extend in the axial direction 2, that is to say parallel to the axis of rotation R.

Figure 3:
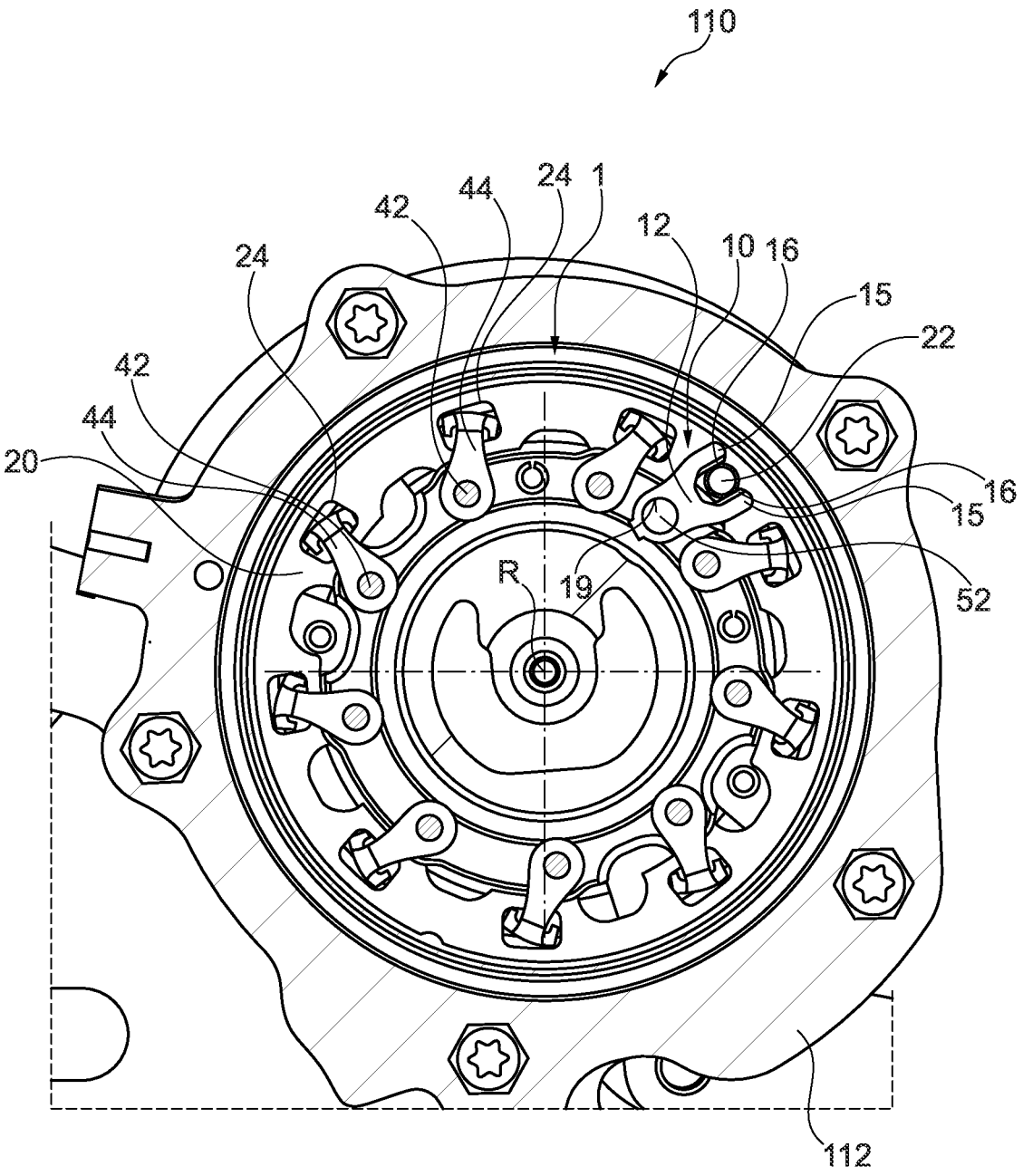
FIG. 3 shows a partially sectional side view of the supercharging device with visible VTG guide vane arrangement and engagement between actuation pin and inner lever.

With regard to FIG. 3, it can be clearly seen that the guide vanes 40 may each have a vane lever 44 by means of which they are coupled to the adjusting ring 20. For this purpose, the adjusting ring 20 may have engagement recesses 24 into which the vane levers 44 operatively engage. For this purpose, the engagement recesses 25 are arranged in the adjusting ring 20 so as to be distributed in the circumferential direction 6. For the purposes of coupling to the operating device, the adjusting ring 20 has an actuation pin 22. The actuation pin 22 may be manufactured integrally with the adjusting ring 20 or may be fixed, for example in the form of a welding stud, to the adjusting ring 20. As can also be seen from FIG. 3, the VTG guide vane arrangement 1 furthermore has a lever 10 that is in operative engagement with the actuation pin 22 in order to rotate the adjusting ring 20.

The lever 10 is coupled via an adjusting shaft arrangement 50 to the operating device 60. In the exemplary embodiment of FIG. 2, the lever 10 is, for this purpose, coupled to an adjusting shaft 52. More specifically, the lever 10 is coupled to a first or inner end of the adjusting shaft 52. On a second, oppositely situated or outer end of the adjusting shaft 52, there is arranged an outer lever 56 that may be coupled to the operating device 50 for example by means of a welded connection or integrally. The outer lever 56 is to be understood to mean a lever that is situated at least partially outside the housing 112, 130 and 122. The lever 10 at the first end may also be referred to as inner lever 10. The adjusting shaft 52 may be mounted rotatably in a bearing device 54, for example of a bearing bushing.

Figure 4A:
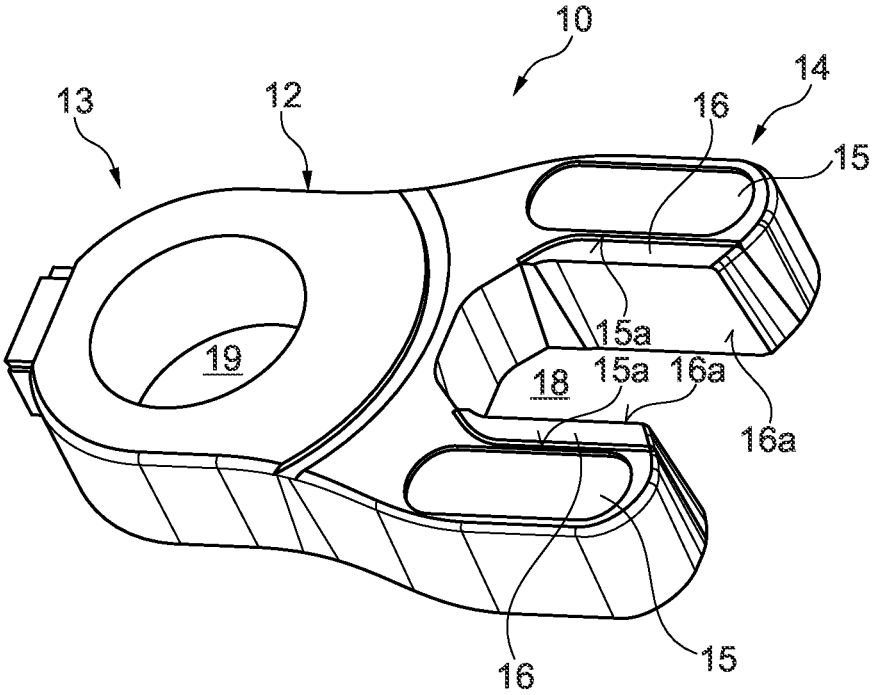
FIGS. 4A-4B are a perspective illustration and a sectional illustration of the lever.
Figure 4B:
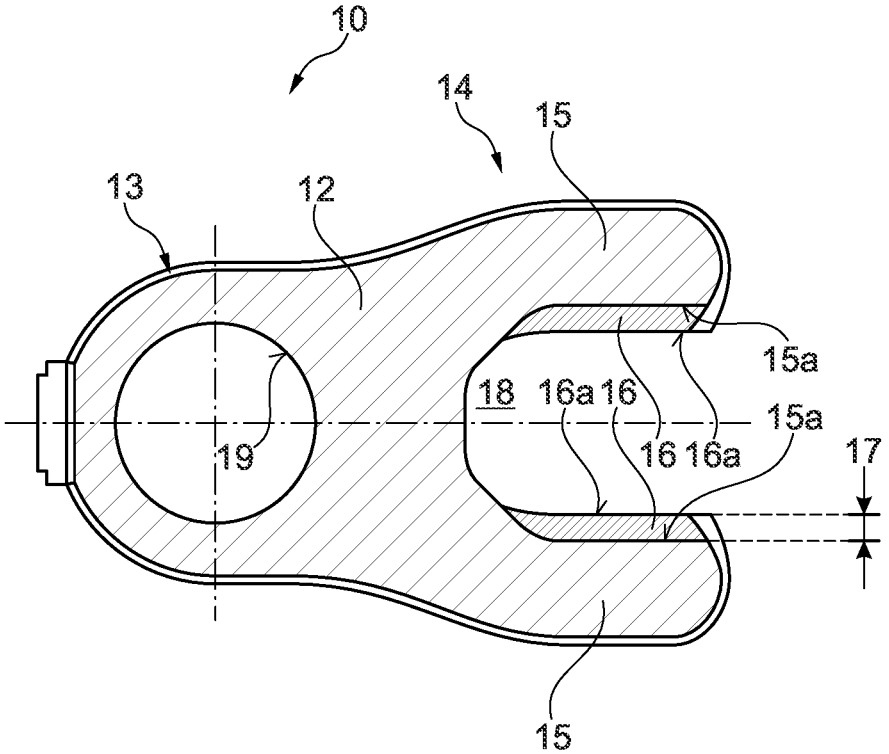

FIGS. 4A and 4B show the inner lever 10 in enlarged views. The lever 10 according to the invention comprises a main body 12 with a fork-shaped coupling section 14 and with an oppositely arranged shaft section 13. The shaft section 13 is configured for coupling to the adjusting shaft 52. For this purpose, the shaft section 13 comprises a shaft recess 19 for engagement with the adjusting shaft 52. The adjusting shaft 52 may for example be connected to the lever 10 by means of a welded connection. Alternative connecting techniques may include pressing together, brazing, riveting and also positively locking connections.

The fork-shaped coupling section 14 comprises two limbs 15. In other words, the two limbs 15 form a fork shape. The limbs 15 are spaced apart from one another such that, between them, there is formed a coupling cutout 18 for coupling to the adjusting ring 20. In other words, the fork-shaped coupling section 14 forms the coupling cutout 18 between the limbs 15. The limbs 15 may be arranged at least partially parallel to one another. The coupling cutout 18 may be of U-shaped form. The fork-shaped coupling section 14 is designed for operative engagement with the adjusting ring 20. The two limbs 15 are spaced apart from one another and comprise two inner sides 15*a*, which point toward one another. A wear-resistant contact block 16 is arranged on a respective inner side 15*a* of the limbs. By being arranged on the limb inner sides 15*a*, the wear-resistant contact blocks are designed for operative engagement with the actuation pin 22 of the adjusting ring 20 (see for example FIG. 2). This gives rise to the effect that there is increased wear resistance at least in the region of the engagement with the VTG guide vane arrangement 1. In this way, it is firstly possible for the durability of the lever 10 and thus of the VTG guide vane arrangement 1 to be increased. Secondly, other material regions of the lever 10 that are not subjected to mechanical load, or are subjected at least to lower mechanical load, such as the shaft section 13, can be produced from materials that are optimized for other characteristics. To name just a few examples, it is for example possible for materials which are cheaper, weight-optimized, strength-optimized and/or optimized with regard to weldability to be used for the other material regions. This can yield a corresponding variety of advantages, such as assembly advantages, economical advantages, ecological advantages and/or performance-related advantages. The expression "wear-resistant" can be understood as meaning "having a high resistance to wear". In other words, the expression "wear-resistant" can be understood as meaning "resistant to wear". The expression "contact block" can be understood to mean a block-shaped insert or plate, pad or shoe that comes into contact with the actuation pin 22 of the adjusting ring 20.

Even though it is the case in the embodiments illustrated here that in each case one wear-resistant contact block 16 is arranged on the inner side 15*a* of both limbs 15, it is also possible in alternative embodiments for a wear-resistant contact block 16 to be arranged only on the inner side 15*a* of one of the limbs 15. This can yield advantages in terms of assembly, such as faster production and/or cost advantages owing to a smaller required material quantity of wear-resistant material. On the other hand, the contact blocks on both sides can give rise to further increased wear resistance, because that side of the fork-shaped section 14 which is in opposition to the natural restoring force of the guide vanes 40 is also of wear-resistant form for potential contact with the actuation pin 22. The natural restoring force arises from the flow or gas pressure which is incident on the guide vanes 40 and which generates a torque from a more tangential orientation of the guide vanes 40 to a more radial orientation of the guide vanes 40. The adjusting ring 20 or the actuation pin 22 thus tends to lie against the fork-shaped section 14 in the direction of rotation that corresponds to a movement in the direction of a more radial orientation of the guide vanes 40. In other words, the actuation pin 22 tends to lie against the inner side 15*a* of that limb 15 in the direction of which the guide vanes 40 orient themselves owing to a more radial orientation. The statements below relating to the contact blocks 16 or coupling surfaces 16*a* can apply both to embodiments with one contact block 16 and to embodiments with two contact blocks 16. In the case of two contact blocks 16, these may be of identical or different design with regard to one or more features.

As can be seen in particular in FIG. 4A, the wear-resistant contact blocks 16 are arranged spaced apart from one another such that the coupling cutout 18 is formed between them. More specifically, the wear-resistant contact blocks 16 each form a coupling surface 16*a*. The coupling surfaces 16*a* are thus arranged on the fork-shaped coupling section 14, in particular on the inner cheeks thereof. The coupling cutout 18 is formed between the coupling surfaces 16*a*. Analogously, in the case of only one wear-resistant contact block 16, the coupling cutout is formed between the coupling surface 16*a* and the inner side 15*a* of the oppositely situated limb. The coupling cutout 18 is configured for operative engagement with the actuation pin 22 of the adjusting ring 20. Thus, during operation, the wear-resistant contact blocks 16 can come into low-wear contact with the actuation pin 22 by way of the coupling cutout 18. More specifically, one or the two coupling surfaces 16*a* can be capable of being placed in operative engagement with the actuation pin 22 of the adjusting ring 20 for the purposes of adjusting the VTG guide vane arrangement 1. For example, a spacing between the two coupling surfaces 16*a* may be dimensioned such that, during operation, only one coupling surface 16*a* comes into contact with the actuation pin 22. That is to say, the actuation pin 22 is arranged between the wear-resistant contact blocks 16. The actuation pin 22 can slide between the coupling surfaces 16*a* or on one and/or both coupling surfaces 16*a*. In other words, the actuation pin 22 can slide forward and backward in the coupling cutout 18.

The wear-resistant contact blocks 16 are ground in order to form the coupling surface 16*a*. The grinding can result in a very smooth surface, which in turn leads to reduced friction and/or increased wear resistance. The coupling surfaces 16*a* have average roughness depths of approximately 3 μm to 5 μm. It would also be possible for wear-resistant contact blocks 16 not to be subjected to postprocessing, or to be subjected to some other form of postprocessing. This range constitutes a good compromise between increased wear resistance and good manufacturability. In alternative embodiments, it is however also possible for the coupling surfaces 16*a* to have average roughness depths of less than 3 μm or more than 5 μm. For example, the wear-resistant contact blocks 16 may be subjected to postprocessing such that the coupling surfaces 16*a* have an average roughness depth between approximately Rz=1 μm and Rz=10 μm. In particular, average roughness depths of Rz≤20 μm have proven to be more wear-resistant than greater roughness depths. The coupling surfaces 16*a* preferably have average roughness depths of Rz≤5 μm. The coupling surfaces 16*a* may particularly preferably have an average roughness depth of Rz≤4 μm. As already mentioned, these statements may apply equally or differently to one or both of the coupling surfaces 16*a*, if present. The wear-resistant contact blocks 16 may be subjected to mechanical postprocessing, chemical postprocessing or energy-based postprocessing (for example by electromagnetic radiation) in order to form the coupling surface 16*a*. In other words, the contact blocks 16 or the surface thereof may be processed, in particular mechanically processed, in order to form the respective coupling surface 16*a*. In particular, the wear-resistant contact block 16 may be subjected to cutting postprocessing in order to form the coupling surface 16*a*. The coupling surfaces 16*a* of the wear-resistant contact block 16 are preferably oriented perpendicular to an axis of the actuation pin 22. In other words, this means that a normal vector with respect to the coupling surface 16*a* is oriented perpendicular to the axis of the actuation pin 22. The wear resistance can be increased in this way. Alternatively, the coupling surfaces 16*a* may be entirely or partially oriented in inclined or curved fashion with respect to the actuation pin 22.

The wear-resistant contact blocks 16 have a thickness 17 of at least 0.1 mm. The thickness 17 of the wear-resistant contact blocks 16 extends from the inner side 15*a* of the corresponding limb 15 to the coupling surface 16*a* formed by the corresponding wear-resistant contact block 16. In other words, the thickness 17 extends substantially orthogonally with respect to a longitudinal extent of the limbs 15. For example, the thickness 17 of the wear-resistant contact block 16 may be 0.1 mm to 3.0 mm, in particular at least 0.5 mm, and preferably 0.6 mm to 1.0 mm. In some particularly preferred embodiments, the thickness 17 of the wear-resistant contact block 16 may be 0.8 mm+/−0.1 mm, which thicknesses lead to particularly good wear resistance and material efficiency. In some embodiments, the wear-resistant contact block 16 may have a variable thickness 17, which is at least 0.5 mm at at least one location and is approximately 0.1 mm or less at at least one other location. By means of such embodiments, particularly material-efficient and positionally accurate or requirement-based wear resistance can be provided. The embodiments described immediately above may apply to both or one of the two wear-resistant contact blocks 16. Likewise, the embodiments described immediately above are applicable to configurations of the lever 10 with only one wear-resistant contact block 16.

In the exemplary embodiment of FIGS. 4A and 4B, the main body 12 with the shaft section 13 and the fork-shaped coupling section 14 is composed of a first material, and the wear-resistant contact blocks 16 are composed of a second material. The first material is a material with good welding characteristics, and the second material has high wear resistance. In particular, the first material has better welding characteristics than the second material. The second material has, in particular, better wear characteristics than the first material. The lever 10 can thus, at its shaft section 13, be welded in an effective manner to the adjusting shaft 52, and at the same time has high wear resistance in the coupling region to the actuation pin 22. Furthermore, through the use of the wear-resistant contact blocks, the expensive wear-resistant material can be used in a requirement-based and positionally accurate manner only where it is required. Furthermore, the rest of the material of the lever 10 can be optimized for other characteristics, for example for greater fatigue strength. Furthermore, the use of separate contact blocks 16 makes exchangeability possible during any maintenance work. It is thus possible for an inner lever 10 to be provided which exhibits high weld quality and high wear resistance.

The first material may for example be a steel alloy with good welding characteristics. For example, the first material may comprise or be composed of Fel7Crl3Ni, X30CrNiNbSi25-20, X6CrNiMoTi17-12-2 and/or X2CrNiMo17-12-2. Other suitable metallic and non-metallic materials may additionally be used for the first material. Good welding characteristics can be understood for example to mean a temperature-stable and weldable alloy. In other words, good weldability can refer to a greater suitability for welding, and/or in particular better weldability, than the second material. The second material may for example be a steel alloy with a cobalt content of at least 20%. For example, the second material may comprise or be composed of Co30Cr8W and/or Co30Mo9Cr. Other suitable metallic and non-metallic materials may additionally be used for the second material. In particular, materials with a high hardness and/or high wear resistance are suitable as second material. In particular, the wear-resistant contact blocks 16 or the second material may have a hardness of between 500 HV0.1 and 1000 HV0.1. The second material or the main body 12 may for example have a hardness of 120 HV10 to 300 HV10.

In embodiments, the wear-resistant contact blocks 16 may have a hardness of at least 500 HV0.1.

In particular, the wear-resistant contact blocks may have a hardness of between 500 HV0.1 and 1000 HV0.1. Preferably, the wear-resistant contact blocks 16 may have a hardness of between 650 HV0.1 and 800 HV0.1.

The wear-resistant contact blocks 16 may be fastened to the limbs 15 by powder-metallurgical methods. In other words, the wear-resistant contact blocks 16 may be fastened to the limbs 15 by means of a powder injection molding connection or by means of a sintering operation. In embodiments, the main body 12 may be produced by powder-metallurgical methods. In particular, the lever 10 may be produced by powder-metallurgical methods. For example, the lever 10 may be produced by metal injection molding.

In preferred embodiments, only the two wear-resistant contact blocks 16 are produced from the second material. The rest of the lever 10, in particular the main body 12, is preferably produced from the first material. In other embodiments, it is for example possible for a region greater than the wear-resistant contact blocks 16 or one or both limbs 15 or the fork-shaped coupling section to be produced partially or entirely from the second material. In embodiments, it is possible for only one or both of the wear-resistant contact blocks 16 to be produced from the second material. In embodiments, it is alternatively or additionally possible for one or both limbs 15 to be produced partially or entirely from the second material. In some embodiments, the fork-shaped coupling section 14 may be produced partially or entirely from the second material. In particular, the elements stated here may be produced by powder-metallurgical methods. The main body 12 may consequently be produced at least partially from the first material. In embodiments, the main body 12 may be produced at least partially from the first material by powder-metallurgical methods.

In alternative embodiments, for example in the case of a positively locking or non-positively locking connection between the limbs 15 and the wear-resistant contact blocks 16, the wear-resistant contact blocks 16 and/or the main body 12 may be produced by fusion casting or in some other manner.

In embodiments, the wear-resistant contact blocks 16 may be fastened in non-positively locking and/or positively locking fashion to the limbs 15. For example, the wear-resistant contact blocks 16 may be fastened to the limbs 15 by means of a screw connection. This allows easy assembly and easy maintenance. As an alternative to the non-positively locking and/or positively locking fastening, the wear-resistant contact blocks 16 may be fastened cohesively to the limbs 15. For example, the wear-resistant contact blocks 16 may be fastened to the limbs 15 by means of a welded connection and/or by means of a brazed connection.

As shown in the example of FIGS. 4A and 4B, the lever 10 is of straight form. In other words, the lever 10 has a substantially straight or planar profile from the shaft section 13 to the fork-shaped coupling section 14. In other embodiments, the lever 10 may be of curved or cranked form (not illustrated in the figures). For example, the lever 10 may have an at least partially arcuate profile from the shaft section 13 to the fork-shaped coupling section 14. In other words, the lever 10 may be formed so as to be curved toward the adjusting ring 20. For example, the lever 10 may have a profile substantially in the form of an s-shaped curve. In the installed state, the arcuate profile gives rise to an arrangement of the fork-shaped coupling section 14 axially closer to the adjusting ring 20, which can result in an improvement in the kinematics and a reduced risk of tilting. Alternatively or in addition to the arcuate profile, the lever 10 may have a stepped formation between the shaft section 13 and the fork-shaped coupling section 14. In other words, the lever 10 may have a cranked formation. A corresponding lever 10 can also be referred to as a cranked lever. In particular, the lever 10 may have an axial stepped formation from the shaft section 13 to the fork-shaped coupling section 14, such that the fork-shaped coupling section 14 is arranged closer to the adjusting ring 20 in the installed state. This, too, can give rise to an improvement in the kinematics and a reduced risk of tilting.

The production of the lever 10 by powder metallurgical methods will be discussed below; this represents one option for the production process. During the production by powder metallurgical methods, the lever 10 or the main body 12 and the wear-resistant contact blocks 16 are produced in a component composite. One option for the production of the component composite composed of the main body 12 and wear-resistant contact blocks 16 is a metal injection molding (MIM) composite casting operation. Metal injection molding refers to metal powder injection molding (powder injection molding). In this regard, a metal powder provided with a binding agent is processed in an injection molding operation. The binding agent is subsequently removed (debinding) and a sintering process is carried out.

Although the present invention has been described above and defined in the appended patent claims, it should be understood that the invention may alternatively also be defined in accordance with the following embodiments:

1. A lever (10) for a VTG guide vane arrangement (1) of a radial turbine (110), comprising: a main body (12) that comprises a fork-shaped coupling section (14) with two limbs (15), wherein a wear-resistant contact block (16) is arranged on an inner side (15*a*) of at least one of the limbs (15) and is designed for operative engagement with an adjusting ring (20) of the VTG guide vane arrangement (1).
2. The lever (10) according to embodiment 1, wherein in each case one wear-resistant contact block (16) is arranged on the inner side (15*a*) of both limbs (15) and is designed for operative engagement with the adjusting ring (20) of the VTG guide vane arrangement (1).
3. The lever (10) according to either of embodiments 1 and 2, wherein the wear-resistant contact block (16) forms a coupling surface (16*a*) that can be placed in operative engagement with an actuation pin (22) of the adjusting ring (20) for the purposes of adjusting the VTG guide vane arrangement (1).
4. The lever (10) according to embodiment 3, wherein the wear-resistant contact block (16) is subjected to mechanical postprocessing, in particular cutting postprocessing, in order to form the coupling surface (16*a*).
5. The lever (10) according to either of embodiments 3 and 4, wherein the wear-resistant contact block (16) is ground in order to form the coupling surface (16*a*).
6. The lever (10) according to any one of embodiments 3 to 5, wherein the wear-resistant contact block (16) is subjected to postprocessing such that the coupling surface (16*a*) has an average roughness depth of $Rz \leq 5$ μm.
7. The lever (10) according to any one of the preceding embodiments where at least dependent on embodiment 2, wherein the wear-resistant contact blocks (16) are arranged spaced apart from one another such that a coupling cutout (18) for operative engagement with the actuation pin (22) of the adjusting ring (20) is formed between the wear-resistant contact blocks (16).
8. The lever (10) according to any one of the preceding embodiments where at least dependent on embodiment 3, wherein the wear-resistant contact block (16) has a thickness (17) of at least 0.1 mm between the inner side (15*a*) of the limb (15) and the coupling surface (16*a*).
9. The lever (10) according to any one of the preceding embodiments, wherein the wear-resistant contact block (16) is fastened to the limb (15).
10. The lever (10) according to embodiment 9, wherein the wear-resistant contact block (16) is fastened in non-positively locking or positively locking fashion to the limb (15).
11. The lever (10) according to embodiment 10, wherein the wear-resistant contact block (16) is fastened to the limb (15) by means of a screw connection.

12. The lever (10) according to embodiment 9, wherein the wear-resistant contact block (16) is fastened cohesively to the limb (15).
13. The lever (10) according to embodiment 12, wherein the wear-resistant contact block (16) is fastened to the limb (15) by means of a welded connection or by means of a brazed connection.
14. The lever (10) according to embodiment 12, wherein the wear-resistant contact block (16) is fastened to the limb (15) by means of a sintering operation.
15. The lever (10) according to any one of the preceding embodiments, wherein the main body (12) is produced at least partially from a first material.
16. The lever (10) according to embodiment 15, wherein the main body (12) is produced at least partially from the first material by powder injection molding.
17. The lever (10) according to either one of embodiments 15 and 16, wherein the first material is a metallic material.
18. The lever (10) according to any one of embodiments 15 to 17, wherein the first material is a steel alloy with good welding characteristics.
19. The lever (10) according to any one of embodiments 15 to 18, wherein the wear-resistant contact block (16) is produced from a second material that has greater wear resistance than the first material.
20. The lever (10) according to embodiment 19, wherein the wear-resistant contact block (16) is produced from the second material by powder injection molding.
21. The lever (10) according to either one of embodiments 19 and 20, wherein one or both limbs (15) is or are produced from the second material.
22. The lever (10) according to any one of embodiments 19 to 21, wherein the fork-shaped coupling section (14) is produced from the second material.
23. The lever (10) according to any one of embodiments 19 to 22, wherein the second material is a metallic material.
24. The lever (10) according to any one of embodiments 19 to 23, wherein the second material is a steel alloy with a cobalt content of at least 20%.
25. The lever (10) according to any one of the preceding embodiments, produced by metal injection molding.
26. The lever (10) according to any one of the preceding embodiments, wherein the main body (12) furthermore comprises a shaft section (13) for coupling to an adjusting shaft (52), which shaft section is arranged opposite the fork-shaped coupling section (14).
27. The lever (10) according to embodiment 26, having an at least partially arcuate profile from the shaft section (13) to the fork-shaped coupling section (14).
28. The lever (10) according to embodiment 26, having a stepped formation between the shaft section (13) and the fork-shaped coupling section (14).
29. The lever (10) according to any one of the preceding embodiments, wherein the wear-resistant contact block (16) has a hardness of at least 500 HV0.1.
30. A VTG guide vane arrangement (1) of a radial turbine (110) for a supercharging device (100), comprising:
    a vane bearing ring (30),
    a multiplicity of guide vanes (40) that are mounted rotatably in the vane bearing ring (30), an adjusting ring (20) for rotating the guide vanes (40), and
    a lever (10) according to any one of the preceding embodiments that is in operative engagement with an actuation pin (22) of the adjusting ring (20) in order to rotate the adjusting ring (20).
31. The VTG guide vane arrangement (1) according to embodiment 30, wherein the guide vanes (40) each have a vane shaft (42) and a vane lever (44), wherein the vane levers (44) are operatively coupled to the adjusting ring (20) and wherein the guide vanes (40) are mounted rotatably in the vane bearing ring (30) by means of the vane shafts (42) in a manner distributed in the circumferential direction (6).
32. The VTG guide vane arrangement (1) according to either one of embodiments 30 and 31 where at least dependent on embodiment 3, wherein the coupling surfaces (16*a*) of the wear-resistant contact block (16) are oriented perpendicular to an axis of the actuation pin (22).
33. The VTG guide vane arrangement (1) according to any one of embodiments 30 to 32 where at least dependent on embodiment 2, wherein the actuation pin (22) is arranged between the wear-resistant contact blocks (16).
34. A radial turbine (110) for a supercharging device (100), comprising:
    a turbine housing (112) that defines a supply duct (113) and an outlet duct (115),
    a turbine wheel (114) that is arranged in the turbine housing (112) between the supply duct (113) and the outlet duct (115), and
    a VTG guide vane arrangement (1) according to any one of embodiments 30 to 33.
35. The radial turbine (110) according to embodiment 34, wherein the VTG guide vane arrangement (1) is arranged radially outside the turbine wheel (114).
36. A supercharging device (100) for an internal combustion engine or a fuel cell, comprising:
    a bearing housing (130);
    a shaft (140) that is rotatably mounted in the bearing housing (130),
    a compressor (120) with a compressor wheel (124),
    a radial turbine (110) according to either one of embodiments 34 and 35, wherein the turbine wheel (114) and the compressor wheel (124) are arranged rotationally conjointly on the shaft (140) at opposite ends.
37. The supercharging device (100) according to embodiment 36, furthermore comprising an electric motor.
38. The supercharging device (100) according to embodiment 37, wherein the electric motor is designed to drive the shaft (140) in rotation.

LIST OF REFERENCE DESIGNATIONS

R Axis of rotation
1 VTG guide vane arrangement
2 Axial direction
4 Radial direction
6 Circumferential direction
10 Lever/inner lever
12 Main body
13 Shaft section
14 Coupling section
15 Limb
15*a* Limb inner side
16 Contact block
16*a* Coupling surface
17 Thickness
18 Coupling cutout
19 Shaft recess
20 Adjusting ring

22 Actuation pin
24 Engagement recess
30 Vane bearing ring
40 Guide vanes
42 Vane shaft
44 Vane lever
50 Adjusting shaft arrangement
52 Adjusting shaft
54 Bearing device
56 Outer lever
60 Operating device
100 Supercharging device
110 Radial turbine
112 Turbine housing
113 Supply duct
114 Turbine wheel
115 Outlet duct
120 Compressor
122 Compressor housing
124 Compressor wheel
130 Bearing housing
140 Shaft

The invention claimed is:

1. A lever (10) for a VTG guide vane arrangement (1) of a radial turbine (110), comprising: a main body (12) that comprises a fork-shaped coupling section (14) with two limbs (15), wherein a wear-resistant contact block (16) is arranged on an inner side (15*a*) of at least one of the limbs (15) and is designed for operative engagement with an adjusting ring (20) of the VTG guide vane arrangement (1).

2. The lever (10) as claimed in claim 1, wherein in each case one wear-resistant contact block (16) is arranged on the inner side (15*a*) of both limbs (15) and is designed for operative engagement with the adjusting ring (20) of the VTG guide vane arrangement (1).

3. The lever (10) as claimed in claim 1, wherein the wear-resistant contact block (16) is fastened in non-positively locking or positively locking fashion to the limb (15).

4. The lever (10) as claimed in claim 1, wherein the wear-resistant contact block (16) is fastened cohesively to the limb (15).

5. The lever (10) as claimed in claim 1, wherein the wear-resistant contact block (16) has a hardness of at least 500 HV0.1.

6. The lever (10) as claimed in claim 1, wherein the wear-resistant contact block (16) forms a coupling surface (16*a*) that can be placed in operative engagement with an actuation pin (22) of the adjusting ring (20) for the purposes of adjusting the VTG guide vane arrangement (1).

7. The lever (10) as claimed in claim 6, wherein the wear-resistant contact block (16) is ground in order to form the coupling surface (16*a*).

8. The lever (10) as claimed in claim 6, wherein the wear-resistant contact block (16) is subjected to postprocessing such that the coupling surface (16*a*) has an average roughness depth of Rz≤20 μm.

9. The lever (10) as claimed in claim 6, wherein the wear-resistant contact block (16) has a thickness (17) of at least 0.1 mm between the inner side (15*a*) of the limb (15) and the coupling surface (16*a*).

10. The lever (10) as claimed in claim 1, wherein the main body (12) is produced at least partially from a first material.

11. The lever (10) as claimed in claim 10, wherein the wear-resistant contact block (16) is produced from a second material that has greater wear resistance than the first material.

12. The lever (10) as claimed in claim 11, wherein the wear-resistant contact block (16) is produced from the second material by powder injection molding.

13. The lever (10) as claimed in claim 11, wherein the second material is a steel alloy with a cobalt content of at least 20%.

14. A VTG guide vane arrangement (1) of a radial turbine (110) for a supercharging device (100), comprising:

a vane bearing ring (30), a multiplicity of guide vanes (40) that are mounted rotatably in the vane bearing ring (30), an adjusting ring (20) for rotating the guide vanes (40), and a lever (10) as claimed in claim 1 that is in operative engagement with an actuation pin (22) of the adjusting ring (20) in order to rotate the adjusting ring (20).

15. A radial turbine (110) for a supercharging device (100), comprising:

a turbine housing (112) that defines a supply duct (113) and an outlet duct (115), a turbine wheel (114) that is arranged in the turbine housing (112) between the supply duct (113) and the outlet duct (115), and a VTG guide vane arrangement (1) as claimed in claim 14.

16. A supercharging device (100) for an internal combustion engine or a fuel cell, comprising:

a bearing housing (130);

a shaft (140) that is rotatably mounted in the bearing housing (130), a compressor (120) with a compressor wheel (124), a radial turbine (110) as claimed in claim 15, wherein the turbine wheel (114) and the compressor wheel (124) are arranged rotationally conjointly on the shaft (140) at opposite ends.

* * * * *